US006705243B2

(12) United States Patent
Kassau

(10) Patent No.: US 6,705,243 B2
(45) Date of Patent: Mar. 16, 2004

(54) SUPPORTING-ARCH CONSTRUCTION AND PROCESS FOR PRODUCING A SUPPORTING ARCH

(75) Inventor: Klaus-Detlef Kassau, Hardegsen (DE)

(73) Assignee: Refratechnik Holding GmbH, Ismaning (DE)

( * ) Notice: Subject to any disclaimer, the term of this patent is extended or adjusted under 35 U.S.C. 154(b) by 0 days.

(21) Appl. No.: 10/139,592

(22) Filed: May 3, 2002

(65) Prior Publication Data

US 2002/0189509 A1 Dec. 19, 2002

(30) Foreign Application Priority Data

May 4, 2001 (DE) ..... 101 21 699

(51) Int. Cl.[7] ..... F23M 5/06
(52) U.S. Cl. ..... 110/341; 110/335; 110/331
(58) Field of Search ..... 110/331, 332, 110/333, 334, 335, 337, 341; 52/593, 594, 595, 58, 86, 9, 575, 245, 608

(56) References Cited

U.S. PATENT DOCUMENTS 624,270 A * 5/1899 Vrooman ..... 52/575
671,199 A * 4/1901 Vrooman ..... 52/575
855,495 A * 6/1907 Baldwin ..... 110/335
912,428 A * 2/1909 Slocomb ..... 52/575
1,064,876 A * 6/1913 Trujillo ..... 52/89
1,285,469 A * 11/1918 Tilley ..... 52/575
1,420,810 A * 6/1922 Bean ..... 52/592.1
1,452,583 A * 4/1923 Williams ..... 52/575
1,590,303 A * 6/1926 Longnecker ..... 110/335
2,206,205 A * 7/1940 Selby ..... 72/101
2,319,065 A * 5/1943 Karmanocky ..... 110/99
2,429,520 A * 10/1947 MacDonald ..... 110/335
2,572,242 A * 10/1951 Burchett ..... 72/38
3,340,831 A * 9/1967 Stein et al. ..... 110/99
3,346,248 A * 10/1967 Martinet et al. ..... 263/33
3,387,575 A * 6/1968 Padfield ..... 110/99
3,489,401 A * 1/1970 Merdian et al. ..... 263/46
4,137,037 A * 1/1979 Daman et al. ..... 432/3
4,152,534 A * 5/1979 Iwashita ..... 13/35
4,177,616 A * 12/1979 Lampert ..... 52/509
4,505,088 A * 3/1985 Lippe ..... 52/747
5,069,015 A * 12/1991 Steinwender ..... 52/575

FOREIGN PATENT DOCUMENTS

BE 0454653 A1 * 10/1991 ..... B22D/41/02
DE 2119051 * 10/1972 ..... F27D/1/04
DE 0862034 A1 * 4/1999 ..... F27D/1/02

* cited by examiner

*Primary Examiner*—Kenneth Rinehart
(74) *Attorney, Agent, or Firm*—Goodman & Teitelbaum, Esqs.

(57) ABSTRACT

A supporting-arch construction having two abutment blocks, one impost, in each case, engaging against each abutment block. Supporting-arch blocks are arranged between the imposts, and are of the same construction. A process is provided for producing such a supporting arch.

34 Claims, 15 Drawing Sheets

SUPPORTING-ARCH CONSTRUCTION AND PROCESS FOR PRODUCING A SUPPORTING ARCH

BACKGROUND OF THE INVENTION

The invention relates to a supporting-arch construction, in particular for vaults of industrial furnaces, such as vertical lime kilns, as set forth below.

The invention also relates to a process for producing a supporting arch, as also set forth below.

Vault structures or supporting-arch structures are required in structural engineering, in particular in construction using shaped bodies or shaped blocks, wherever a region has a cavity beneath it and the load of the structure or masonrywork located above the cavity has to be diverted to the walls or pillars bounding the cavity laterally. Since the time of the Romans, in many sacred and also secular buildings, supporting arches or vaults have helped to span cavities with roofs or false floors or to produce bridges. The vaults or supporting arches here can achieve considerable spans and divert laterally into the masonrywork or auxiliary structures, such as columns and pillars, forces which are introduced at their apex or the arch surfaces.

It is also the case in industrial-furnace construction that use is made of vaults and supporting arches of different spans in order to provide a furnace cavity which can have further cavities or masonry structures constructed above it. It is generally customary for vaults or supporting-arch structures to be constructed such that first of all a center is produced, for example from wood, and then, from two sides to the apex, the blocks which form the supporting arch of the vault are built up thereon in opposite directions as far as the apex. A so-called keystone is then introduced at the apex and, with support against said keystone taking place on all sides in the case of domes and on two sides in the case of supporting arches or supporting barrel vaults, the supporting arch is supported against the keystone by way of its two oppositely directed sections. The center can then be removed and the vault or the supporting arch stands freely.

DE 39 33 744 C2 discloses a set of keystones for installation in the transition region between two oppositely directed sections of a vault-like supporting structure made of refractory blocks. In the case of this known structure for supporting arches, the supporting structure is formed from two sections which are directed toward one another in opposite directions, the set of keystones being inserted in the transition region between the two sections and comprising two transition stones which on their outside, adjacent to the respectively last block of the corresponding section, have a groove/tongue profile which tapers conically from top to bottom, is designed to correspond to the appropriate groove/tongue arrangements of the adjacent block and is thus intended to make it possible for the blocks to be laid securely in a close-fitting manner, and the set of keystones further comprising at least one keystone which is shaped such that it can be inserted axially in a form-fitting manner into the space between the previously inserted stones. This is intended to ensure that, in the case of repairs, this keystone has to be removed axially, as a result of which the supporting structure is opened in order for it to be possible for further stones or blocks to be removed and exchanged in the case of repair. Theoretically, this is intended to achieve the situation where, for the purpose of opening the supporting arch, the keystone, rather than being capable of being removed upward into the region of a masonry structure located thereabove, can be drawn out axially without part of the masonry structure located thereabove having to be removed. This known embodiment has not proven successful in practice and has therefore been modified to the effect that the grooves and tongues have steps (FIG. 14) which make possible a somewhat higher stability against lateral axial pressure. As a result, however, it is necessary for the keystone to be drawn out radially upward from the supporting arch, with the result that there is no longer any advantage achieved over conventional keystones for vault structures. A considerable disadvantage, however, is that the set of keystones comprises three stones and thus gives rise to considerably increased production outlay in comparison with normal keystones.

EP 0 862 034 B1 likewise discloses a set of keystones for a vault made of refractory blocks, comprising two adapter stones, which can be connected to the refractory blocks in a force-fitting manner, and a wedge-shaped keystone, it being possible for the wedge-shaped keystone to be inserted axially into the space between the adapter stones which is to be closed, and the adapter stones and the keystone being inserted into a joint bed of mortar. In the case of this known structure, the connection surfaces of the adapted stones and of the keystone which are supported against one another in the installed state are designed as planar, step-free surfaces, grooves being arranged in said surfaces and, following the insertion of the keystone, supplementing one another to form a channel which is axially open on the end sides, with the result that the channels each accommodate a solid coupling rod, which can be introduced at the end sides, made of a plain carbon steel. The disadvantage with this embodiment of a set of keystones or of a supporting arch is that, as a result of different materials being introduced, the supporting arch is inhomogeneous both in chemical terms and in terms of materials and, in particular, the coupling rods may burn out during use, with the result that permanent stability is not provided.

CH 453 568 discloses a similar solution, in this case the channels being formed and/or bounded by metal plates pushed in between the stones, this solution being envisaged for brick linings for rotary kilns.

DE-A 21 19 051 proposes, for the vault-like brick lining of rotary kilns, so-called voussoirs having obliquely running wedge-shaped protrusions in their side walls. In order to complete an arch or a circle of the rotary kiln, use is made of keystones which have one smooth side surface which is vertical or inclined in relation to the base surface, while the other side surface has the shoulder, or the necessary wedge-shaped protrusion, which is needed for connection to the rest of the blocks. It is also disadvantageous, in the case of such an embodiment, that axial forces cannot be reliably absorbed at least in the region of the keystone.

DE-C 481 676 discloses a block for furnace-chamber ceilings which, on one of its side surfaces, has a V-shaped protrusion with an upwardly directed tip and, on an opposite surface, has a corresponding groove. The protrusion and groove are each continued downward as far as a glazed bottom surface of the block, the protrusion and groove each being in the form of a closed triangle. This is intended to avoid the situation where ruptures along certain lines result in the broken-off parts dropping out, with corresponding exposure of non-glazed parts of the ceiling to the heat, and the ceiling is rapidly destroyed. According to this document, it is necessary, during the construction of an annular firing surface using these shaped bodies, for wedge-shaped stones to be inserted into suitable interspaces. These stones are designed in the same way as the abovementioned blocks, but have a smooth surface without any protrusion or a groove. It is also disadvantageous here that, in the region of the voussoir or of the voussoirs, the supporting arch is weakened, in particular in the axial direction. It is further disadvantageous that the keystone, for repair work, has to be drawn out of the supporting arch in the upward direction over the entire stone height.

BRIEF SUMMARY OF THE INVENTION

It is an object of the invention to provide a supporting-arch construction which results in a straightforwardly constructed supporting arch and can be installed more easily and with less outlay, and has a higher load-bearing strength, than known supporting arches.

The object is achieved by a supporting-arch construction having the features set forth below.

Advantageous developments are specified below.

It is also an object to provide a process for producing a supporting arch by means of which a supporting arch can be installed reliably, easily and with little outlay and the supporting arch achieved is one with high load-bearing strength.

The object is achieved by a process for producing supporting arch having the features set forth below.

According to the invention, a supporting arch is formed by way of a standard block format, i.e. there are no separate adapters or keystones required.

It is only the imposts of the supporting arch which, as is also customary in the prior art, are of a different shape. On the supporting arch side, they correspond, as far as the surface is concerned, essentially to a supporting-arch-block format and, on a bearing-side surface, the latter surface is smooth. The block formats of the supporting-arch structure according to the invention have a specifically designed contour with a step which has a shape and a ramp angle which, surprisingly, has been found to be statically particularly stable.

The process according to the invention makes provision for the arch to be constructed from one abutment block, beyond the apex, and for the last block which is to be inserted to be the abutment voussoir or impost which rests on the other abutment block opposite. This has the advantage that, in the case of a repair, the masonry structure located above the supporting arch, in the vast majority of cases, need not be broken out at all since, at the location at which the impost is inserted, there is usually a gap, between this block and the masonry structure above, which is filled with mortar.

It is thus advantageous in the case of the invention that supporting arches can be produced straightforwardly and reliably, reduced production outlay rendering the supporting arches favorable, and the supporting arch according to the invention or the supporting-arch construction according to the invention being statically very highly loadable.

BRIEF DESCRIPTION OF THE SEVERAL VIEWS OF THE DRAWINGS

The invention is explained by way of example hereinbelow with reference to a drawing, in which.

DETAILED DESCRIPTION OF THE INVENTION

Figure 1:
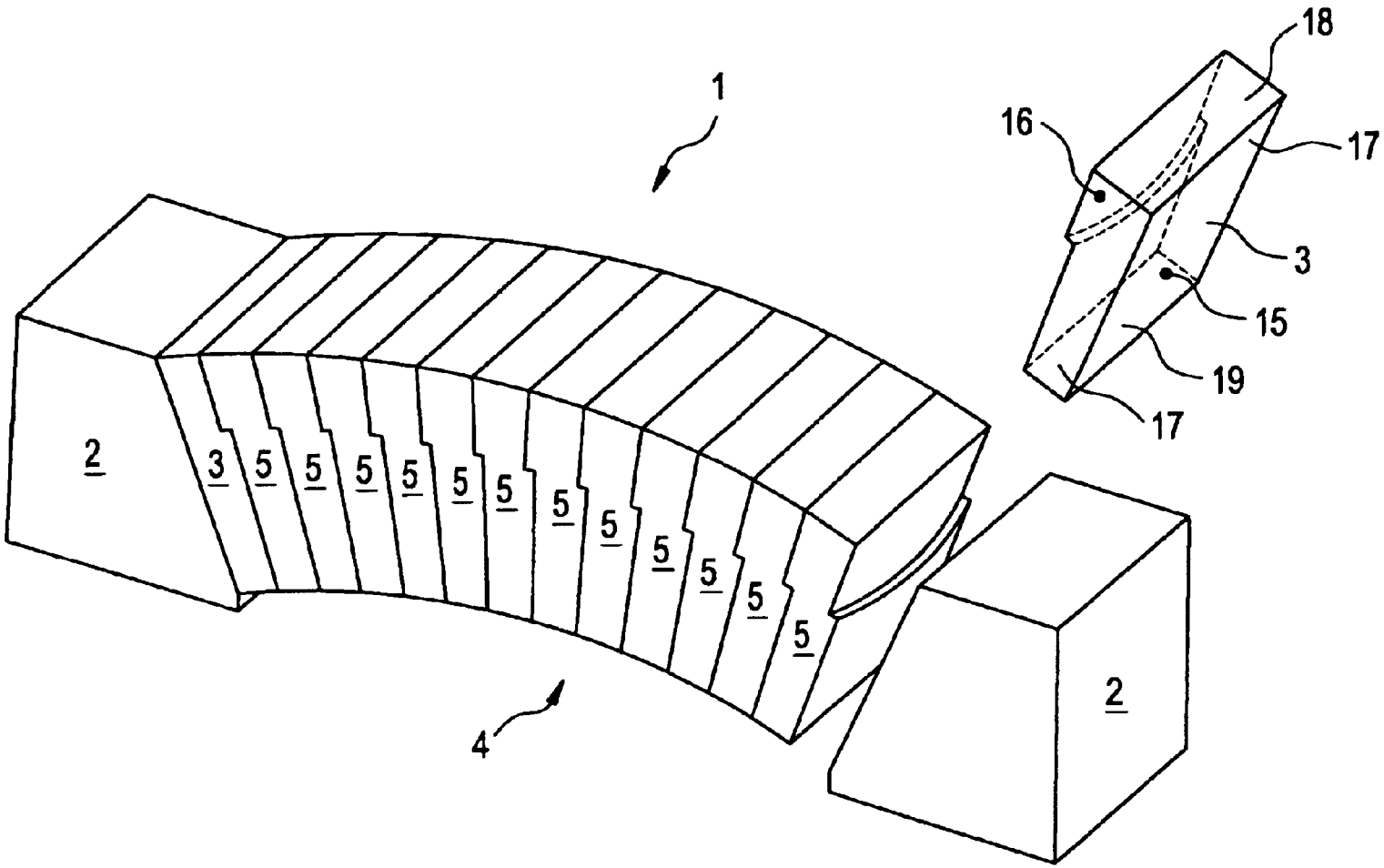
FIG. 1 shows a perspective view of a supporting-arch construction according to the invention.
Figure 2:
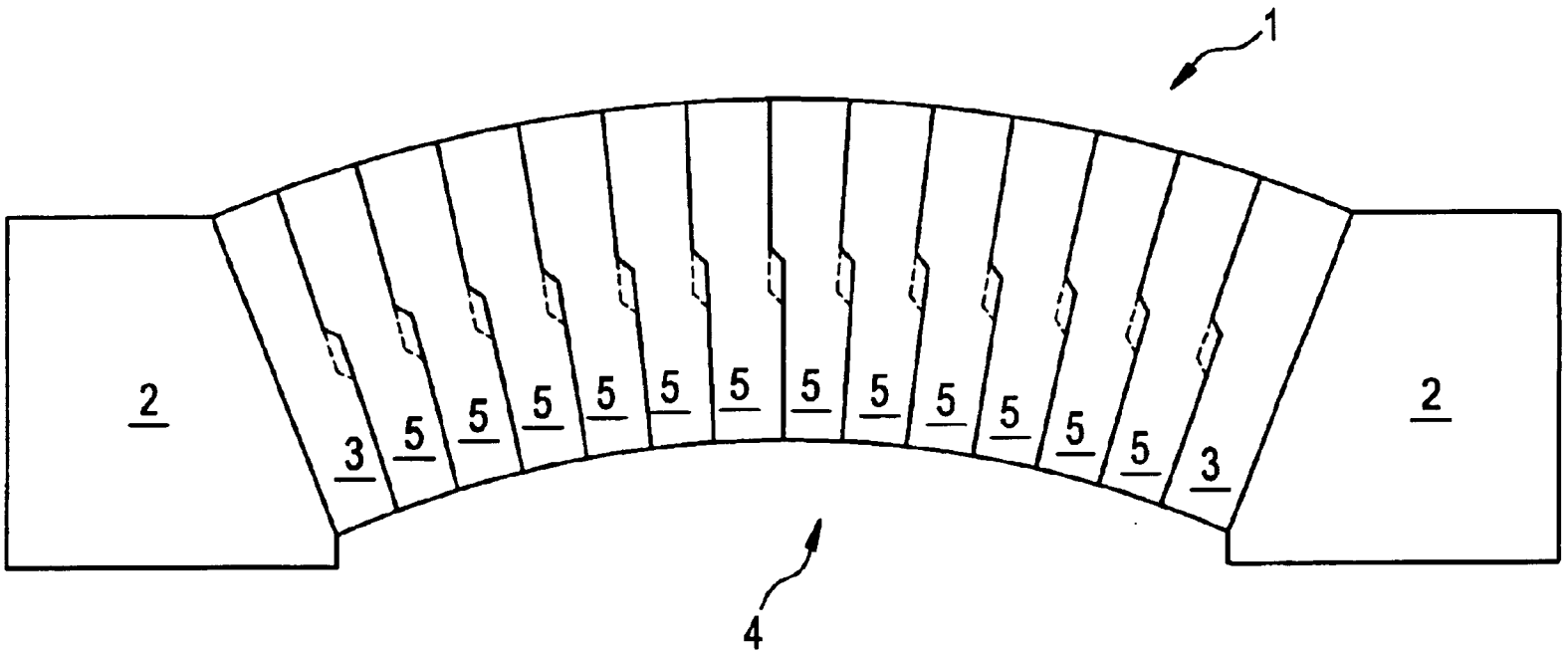
FIG. 2 shows a plan view of the construction according to the invention from FIG. 1.

A supporting-arch construction 1 (FIGS. 1, 2) according to the invention has two mutually opposite abutment blocks or elements 2, in each case one abutment voussoir 3 or impost 3 resting on the abutment blocks 2, and, between the imposts 3, the supporting arch 4, which is formed from a plurality of supporting-arch blocks 5 of the same type.

The abutment blocks 2 are of essential cuboidal design and have a base wall 6, a rear wall 7, a top wall 8, two side walls 9 and a front or beating wall 10. The front or bearing wall 10 has, adjacent to the base wall 6, a narrow wall section 11 running parallel to the rear wall 7. Above the wall section 11, a bearing surface 12 extends obliquely, at a predetermined angle, toward the rear wall 7 and terminates with the top wall 8. The bearing surface 12 of the bearing wall 10 is of planar design. The bearing surface 12 bears an impost 3.

The impost 3 has a bearing wall 15, a supporting wall 16, which is located opposite the bearing wall 15, two parallel side walls 17, which connect the bearing wall and supporting wall, and a top wall 18 and a base wall 19.

The impost 3 is of slightly wedge-shaped design, the impost 3 tapering from its top wall 18 to the base wall 19.

The supporting wall 16 has a contour which serves to achieve, with the next-following supporting-arch block 5, a defined form fit which establishes the position of the blocks.

Figure 4:
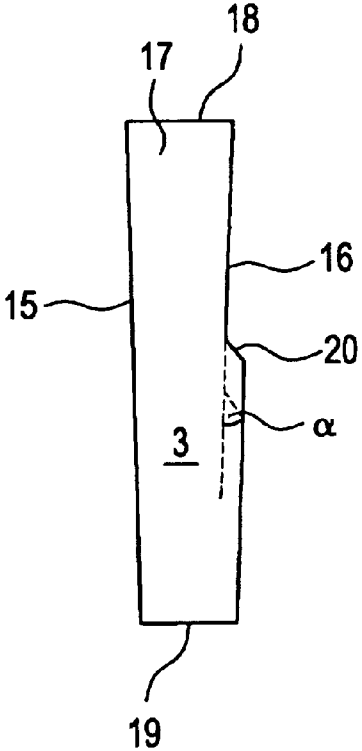
FIG. 4 shows a side view of the impost according to FIG. 3.
Figure 3:
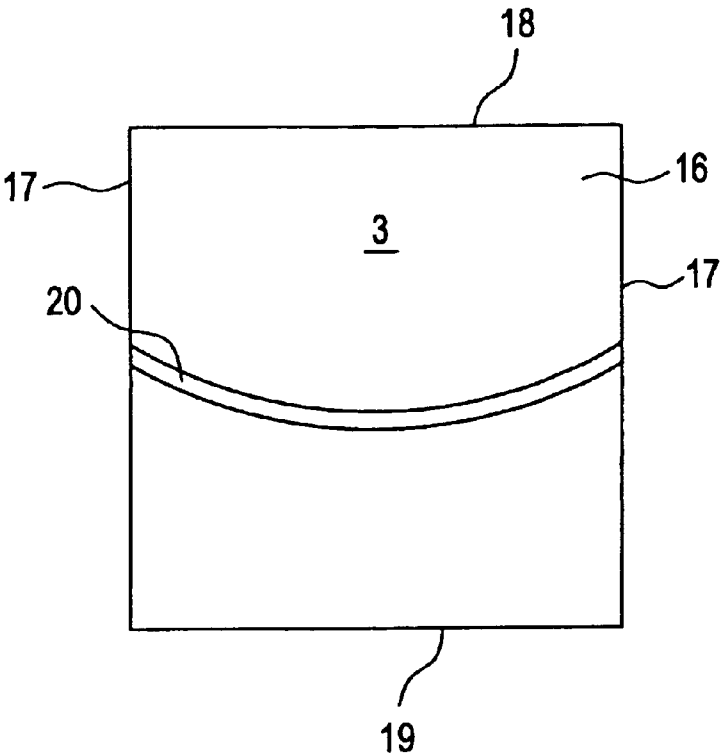
FIG. 3 shows a plan view of a first embodiment of an impost.
Figure 6:
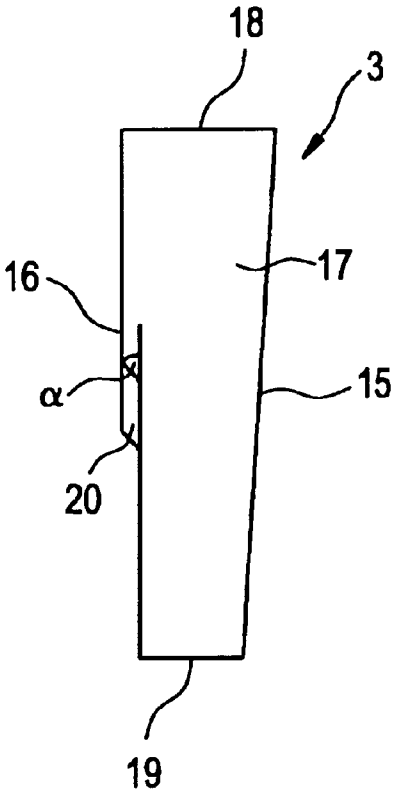
FIG. 6 shows an impost according to the invention which is arranged opposite the block according to FIG. 3.
Figure 5:
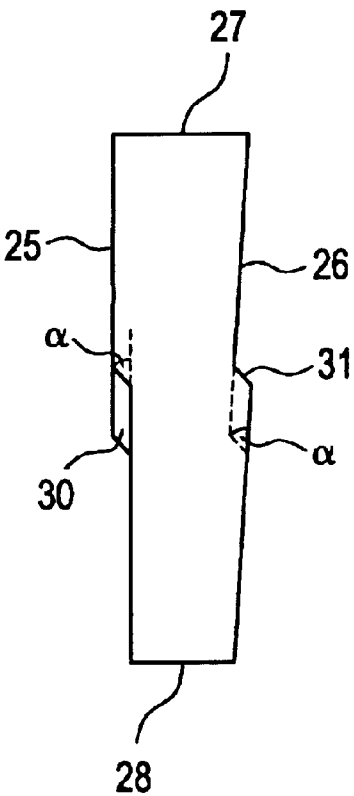
FIG. 5 shows a first embodiment of a supporting-arch block according to the invention.
Figure 8:
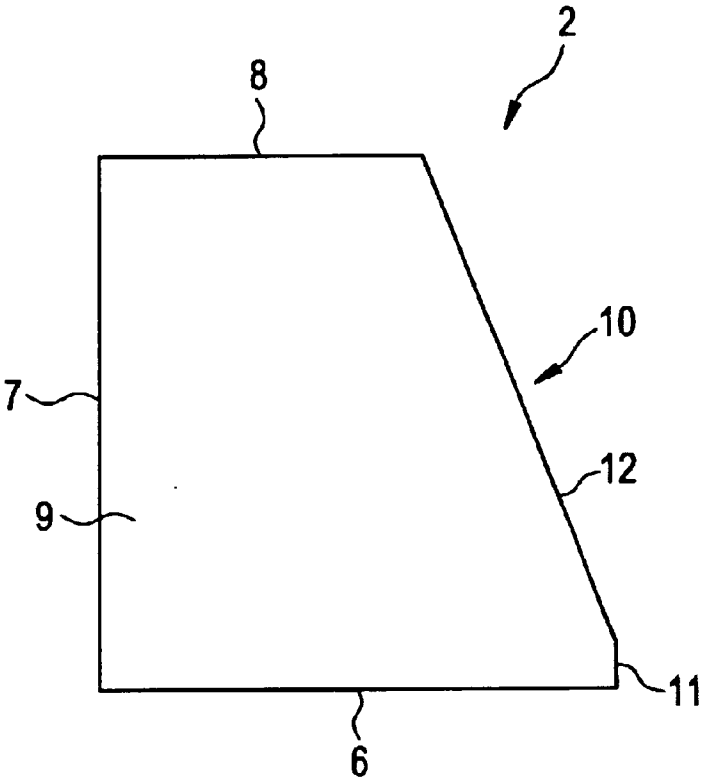
FIG. 8 shows a lateral view of the block according to FIG. 7.
Figure 7:
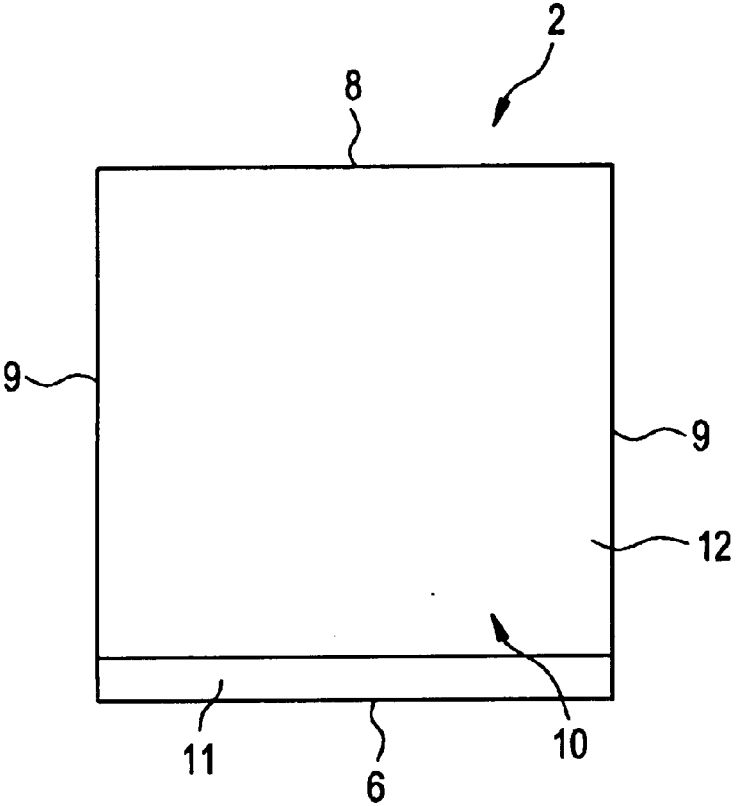
FIG. 7 shows a plan view of an abutment block for the impost.

The contour comprises, for example, a shoulder 20 or a step 20 in the supporting wall 16 (FIGS. 4, 6).

From the step 20, the impost 3 narrows in the direction of the base wall 19. The step 20 runs in an arcuately curved manner and extends approximately from the center of one side wall 17 to the opposite side wall 17, the step 20 (FIG. 1) being curved downward in the direction of the base wall 19. The step 20 runs in oblique or inclined manner, and has a ramp angle α which is from 30° to 60°, in particular 45°.

The actual supporting arch 4 is formed from the supporting-arch blocks 5. The supporting-arch blocks 5 are of wedge-shaped design, with a front supporting wall 25 and a rear supporting wall 26, which run toward one another from a common top wall 27 to a common base wall 28. Furthermore, the supporting-arch block 5 has two planar side walls 29 which connect the front and rear supporting walls 25, 26. The front supporting wall 25 and rear supporting wall 26 each have a contour. The contour of the supporting wall 25 has, for example, a step 30 which runs obliquely at the angle α. By way of the step 30, the supporting-arch block 5 tapers in a step-like manner from the top wall 27 to the base wall 28. The step 30 is designed to correspond to the step 20 of the impost 3 and runs in an arcuately curved manner and thus extends approximately from the center of one sidle wall 29 to the opposite side wall 29, the step 30 being curved concavely downward in the direction of the base wall 28.

The rear supporting wall 26 likewise has a contour, the contour of the rear supporting wall 26 comprising, for example, a step 31 which runs obliquely at the angle α. By way of the step 31, the supporting-arch block 5 widens in a step-like manner from the top wall 27 to the base wall 28. The step 31 runs in an arcuately curved manner and extends, preferably level with the step 30, from one side wall 29 to the opposite wide wall 29, the step 31, in a manner corresponding to the step 30, running convexly in the direction of the base wall 28. The step 20 and the step 31 are designed to correspond with one another such that a supporting-arch block 5 resting on the impost 3 has its rear supporting wall 26 resting on the supporting wall 16, the step 20 engaging in a form-fitting manner in the step 31, and the top wall 18 and the base wall 19 of the impost 3 terminating with the top wall 27 and the base wall 28 of the following supporting-arch block 5. The side walls 17 of the impost 3 and the side walls 29 of the supporting-arch block 5 here run in alignment. The contours of the rear supporting wall 26 and of the front supporting wall 25 of the supporting-arch blocks 5 correspond with one another such that the supporting-arch blocks are likewise introduced one inside the other in a form-fitting manner such that the side walls are aligned and the top and bottom walls terminate with one another. Their wedge shape with defined tapering results in an arch of defined length and span. Arranged opposite the first impost 3, on the opposite abutment block, is a second impost 3, which, in respect of the contour of the supporting wall 16, as has been described above, corresponds with the contour of the front supporting wall 25 of the supporting-arch block 5, i.e. it has a contour which corresponds to the rear supporting wall 26 of a supporting-arch block 5.

Figure 9:
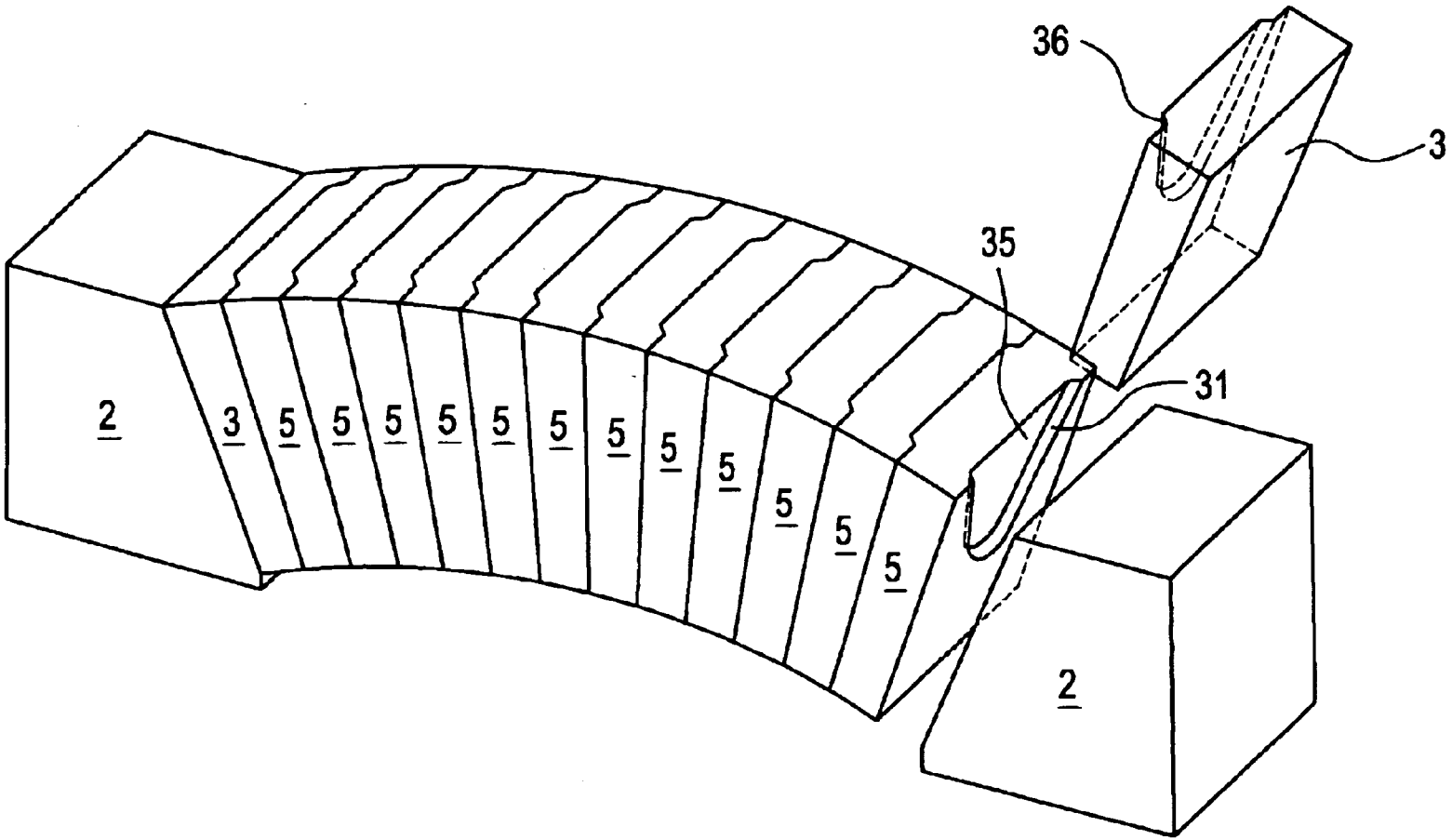
FIG. 9 shows a further embodiment of the supporting-arch construction according to the invention.
Figure 10:
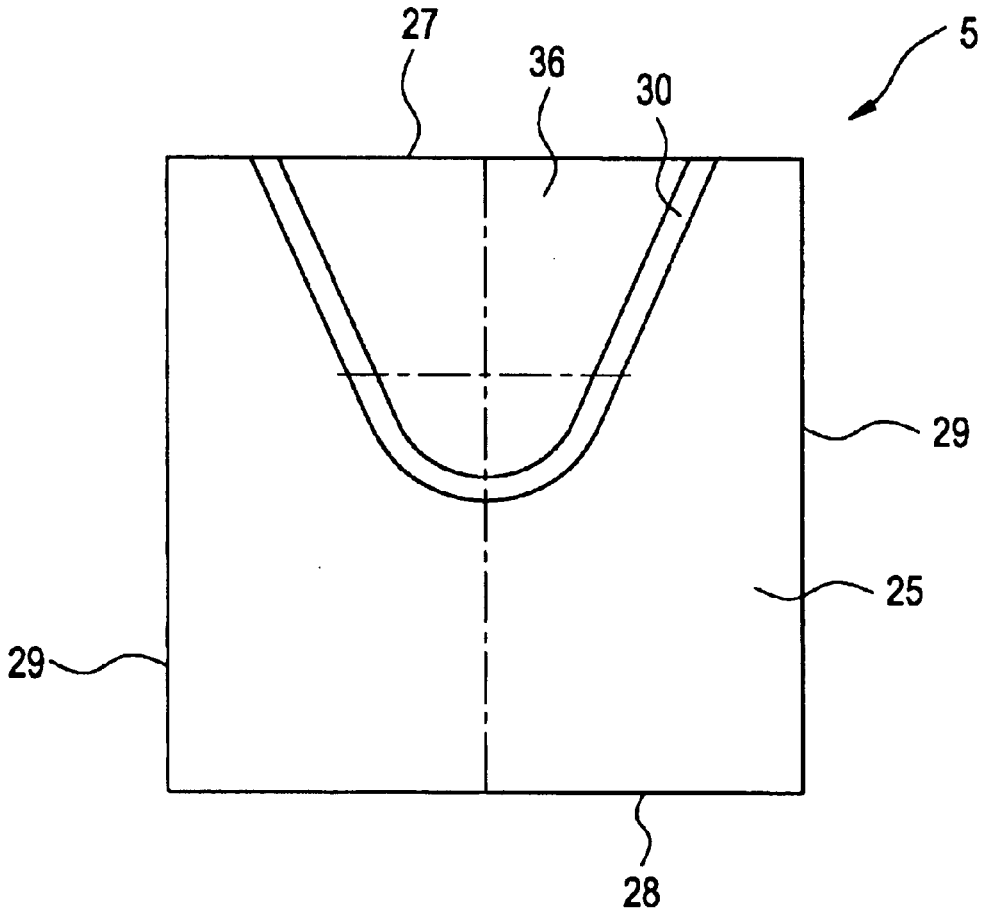
FIG. 10 shows a plan view of a supporting-arch block for a supporting arch according to FIG. 9.

In the case of a further embodiment (FIGS. 9, 10), the steps 20, 30, 31 run in an oval manner, in particular in an acutely oval manner, from the respective top wall 18 or 27 toward the base wall 17 or 28, this forming, in the walls 26, recesses 35 which open in the direction of the top wall and, in the walls 16 or 25, noses or protuberances 36 which widen toward the respective top wall 18 or 27. With the supporting arch assembled, the noses 36 of one block 3, 5 engage in a form-fitting manner in the recesses 35 of the adjacent block, the flanks of the steps 20, 30, 31 likewise resting one upon the other in a form-fitting manner.

Figure 11:
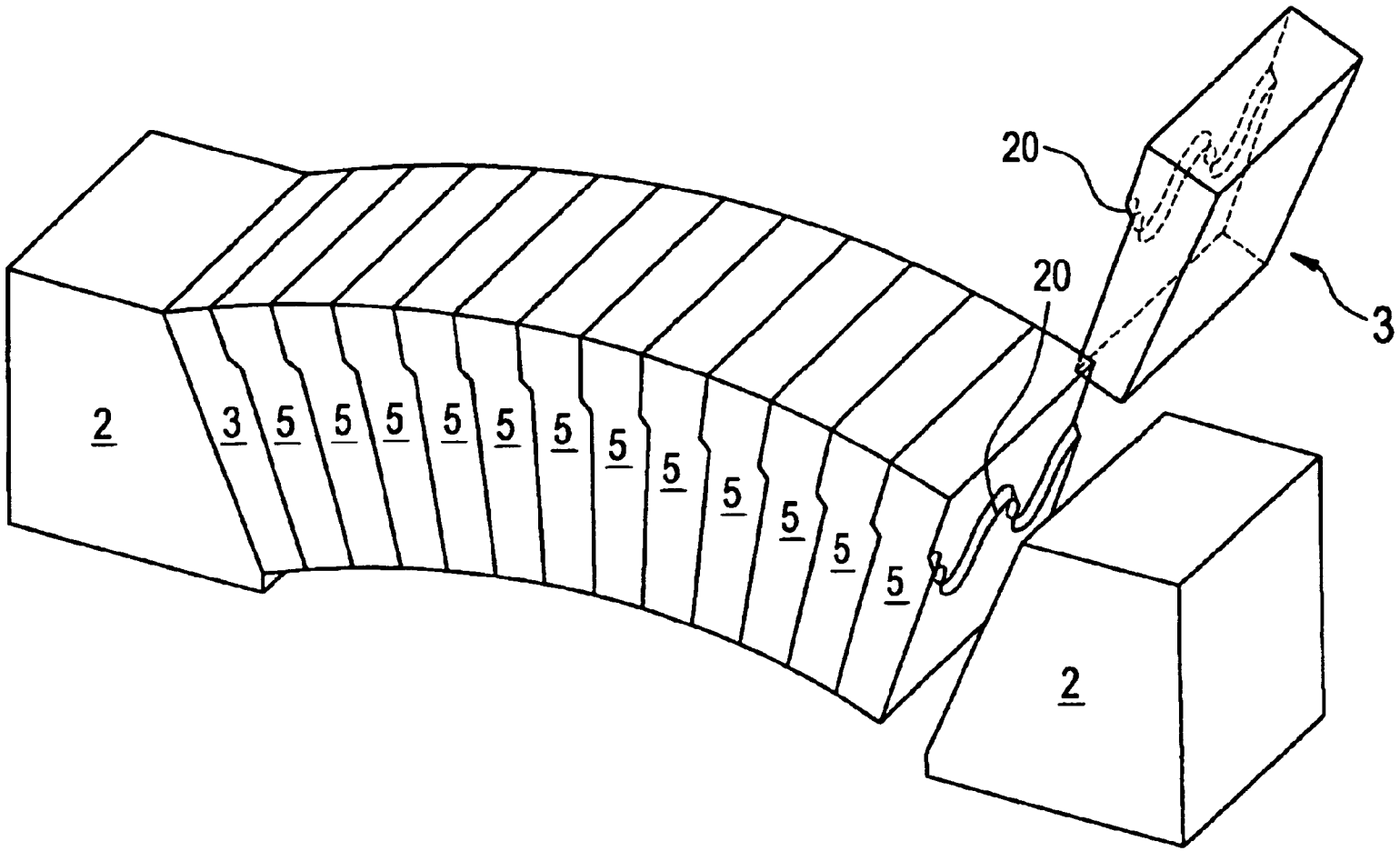
FIG. 11 shows a first embodiment of a supporting-arch construction according to the invention.
Figure 12:
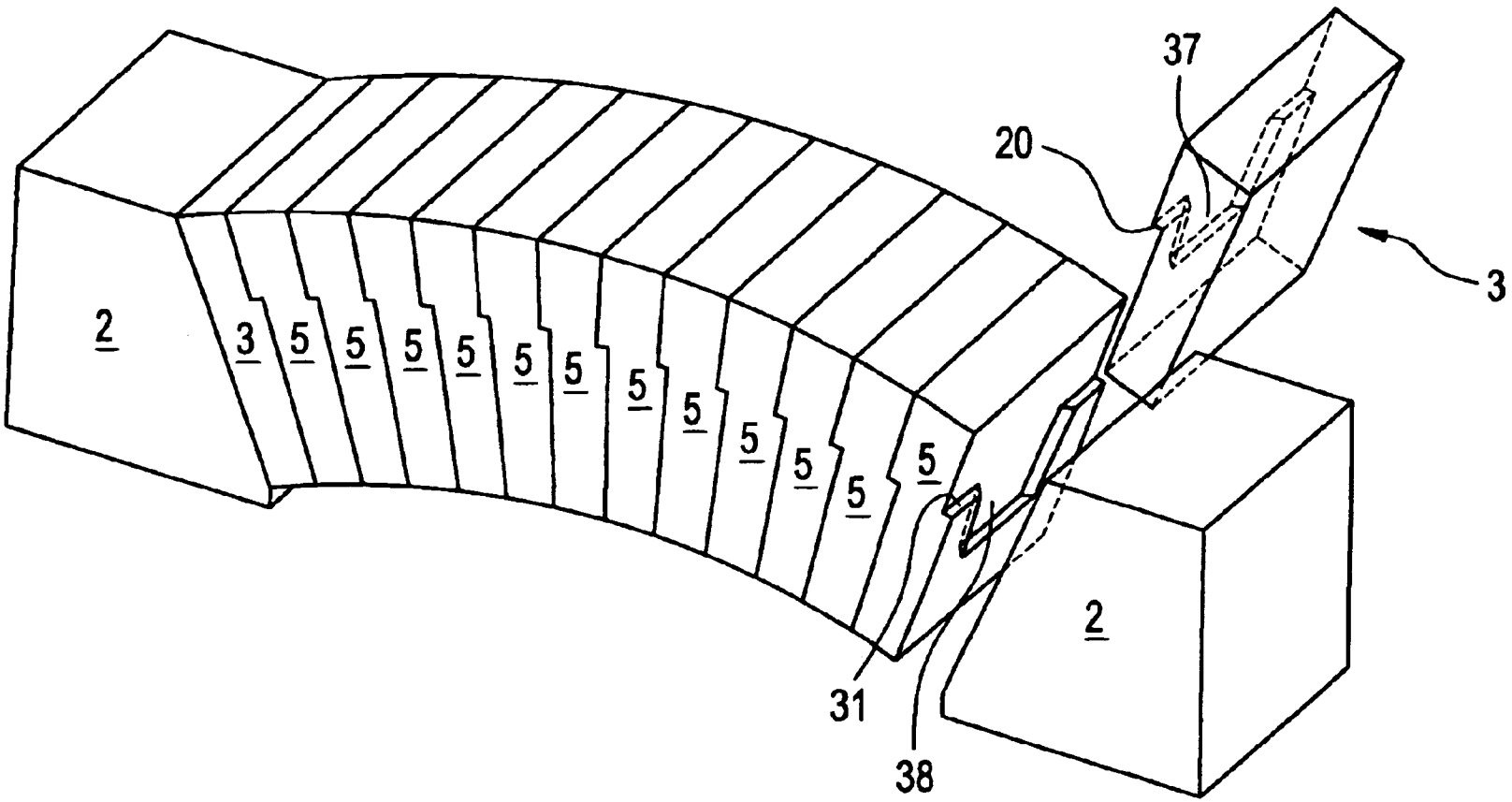
FIG. 12 shows a further embodiment of a supporting-arch construction according to the invention.

Furthermore, it is also possible for the step 20, 30, 31 to run in an undulating manner (FIG. 11) or to run initially parallel to the base wall 28, 19, from the side walls 17, 29, a little way an the direction of the block center in order then to be inflected on both sides, with the result that an upwardly or downwardly directed triangularly acute or parallelogram-shaped or rectangular or square nose 37 or recess 38 is formed along the course of the step (FIG. 12).

In contrast to the hitherto known groove/tongue configurations, the design of a step, in particular of a concave/convex step, according to the invention provides the advantage that such steps can be produced cost-effectively since the concave/convex shape can be machined more straightforwardly than the angled or semicircular groove and tongue shape. Furthermore, the steps according to the invention, by virtue of the radian measure of the step which results from this shape, provide a considerably larger surface area for absorbing the dead weights which act on the supporting arch. Prior-art structures have a considerably smaller surface area for accommodating corresponding loads, which, in many cases, results in stress-induced material rupture. The chamfering according to the invention has the advantage that it helps to reduce the notch effect. In conjunction with the uniform construction of the vault, the concave or convex step, running horizontally in relation to the course direction, provides the advantage that there is no continuous joint produced in the central region of the top apex. Continuous joints, from both a thermomechanical point of view and a thermochemical point of view, basically constitute a weak point of a supporting-arch or vault construction since they give rise, on the one hand, to gas leakage and, on the other hand, to reduced form fitting and/or force fitting. Furthermore, the supporting-arch construction according to the invention has the advantage that, since only standard supporting-arch blocks are used, there is a uniform distribution of stressing prevailing in the supporting arch. In contrast to this, the prior-art construction is inhomogeneous as a result of a plurality of different shaped formats being used.

Calculations using the finite element method have shown that the static loadability of the supporting-arch construction according to the invention is considerably greater than that of previously known supporting-arch constructions. In particular, it has been possible to demonstrate uniform homogeneous stressing distribution.

The process according to the invention for producing a supporting arch is explained hereinbelow. In order to produce the supporting arch according to the invention, a center is produced, this extending from one abutment block 2 or one abutment element 2 to the opposite abutment block 2 or abutment element 2. The center here has an upward curvature which corresponds to that of the supporting arch which is to be produced. First of all, then, an impost 3 or abutment voussoir 3 is positioned, by way of its bearing wall 15, on a bearing surface 12 of one abutment block 2. The bearing wall 15 of the impost 3 preferably terminates with the bearing surface 12 of the abutment block 2 on all sides. Then as far as the top apex of the supporting arch, supporting-arch blocks 5 are laid in a form-fitting manner in each case on the preceding block, the first supporting-arch block 5 being laid in a form-fitting manner on the impost 3 resting on the abutment block 2. Once the top apex has been passed, the subsequently laid blocks, or the blocks which are to be laid, are fixed against one another by means of a special assembly adhesive as they are installed. Once the last vault block has been laid, it is possible for the opposite impost 3 or abutment voussoir 3 to be inserted into the supporting-arch construction between the abutment block 2 and the last supporting-arch block 5.

By virtue the of blocks being laid in a precise manner in the dry state prior to the actual installation in the furnace system, it is possible to determine the precise dimensions of the abutments. In order to compensate for changes in length or tolerances during the block production, the invention makes provision for imposts 3 of different thicknesses, for example two of one kind in each case, to be enclosed with a pack of supporting-arch blocks 5. This has the advantage that the by far greater number of blocks, namely the supporting-arch blocks 5 can always be produced identically, while the imposts 3, which are produced in special formats anyway, are produced in different, appropriate thicknesses. For example, if, despite careful preparation, the last impost 3 or abutment voussoir 3 should not fit precisely, this impost 3 is also supplied in alternative formats, in each case one varying by +2 mm and one varying by −2 mm in respect of the tapering. By virtue of this possibility of variation, optimum installation is achieved even in the case of dimensional deviations.

In the installed state (FIG. 13), the supporting arch 4 extends, by way of its supporting-arch blocks 5, between the abutment blocks 2 as well as the abutment voussoirs 3 or imposts 3. The further masonry structure 40 extends above the supporting arch 4, and a regulating mortar course 41 is usually arranged between the masonry structure 40 and the supporting arch 4, in particular following repairs.

In order to dismantle a defective supporting arch, it is usually sufficient according to the invention for this mortar course 41 to be broken out and then for the last-inserted abutment voussoir 3 or impost 3 to be raised upward, by the height h of the curvature of the step 20, into the region of the broken-out regulating course and removed. If appropriate, it is possible for this impost 3 to be moved upward together with the next-following supporting-arch block 5*a* if the movement of a single block is blocked. Conversely, with a suitable selection of the step height and/or of the height of the regulating course 41, it is then possible for the blocks 3, 5 of the entire supporting arch 4 to be renewed without—as is customary in the prior art—the masonry structure located thereabove halving to be broken out, since it is only with the changeover of the last block that the latter has to be lowered into the block assembly from above. Sufficient space is nevertheless provided for this according to the invention.

Figure 13:
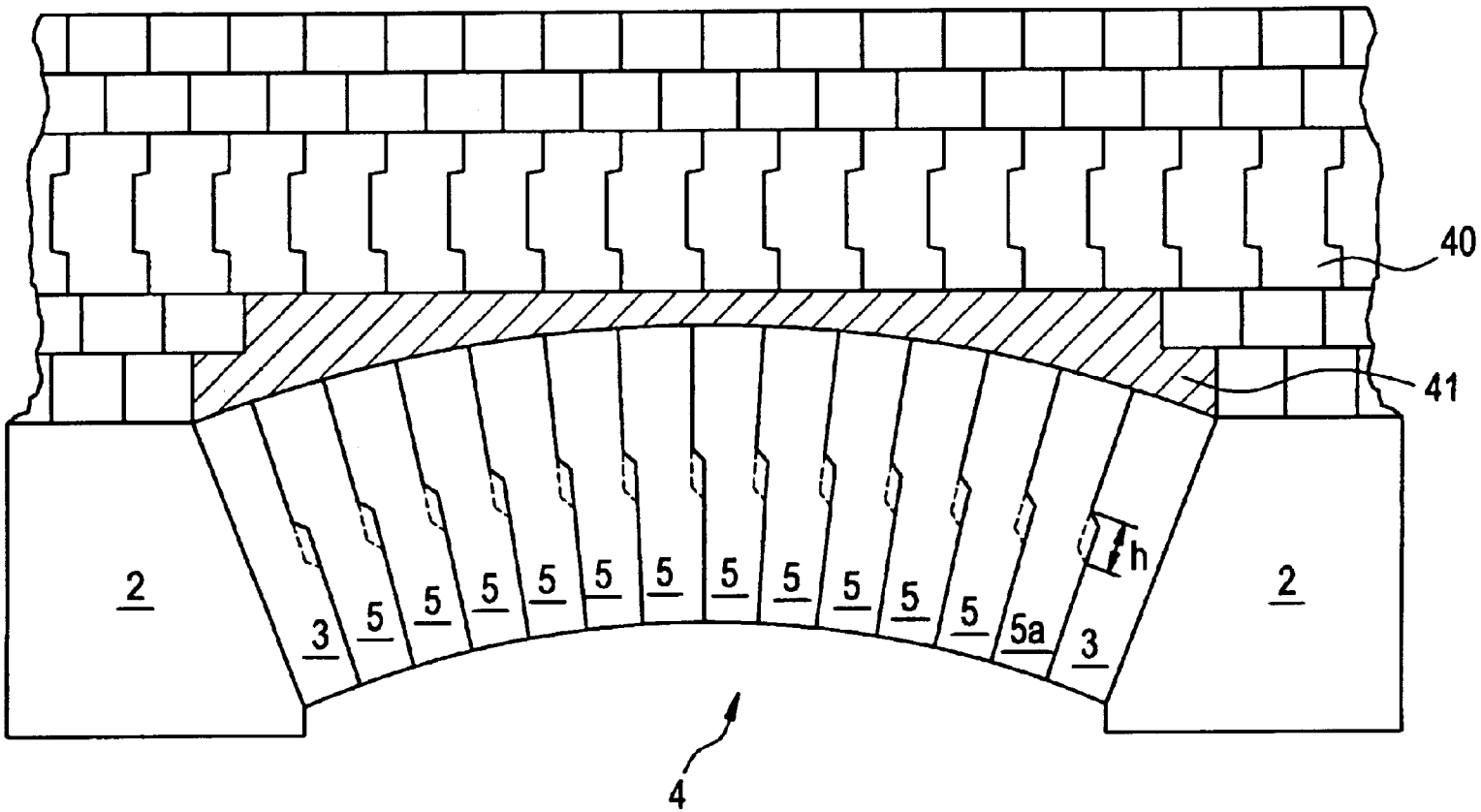
FIG. 13 shows the situation of installing a supporting-arch construction according to the invention, in particular upon installation in an existing masonry structure.
Figure 14:
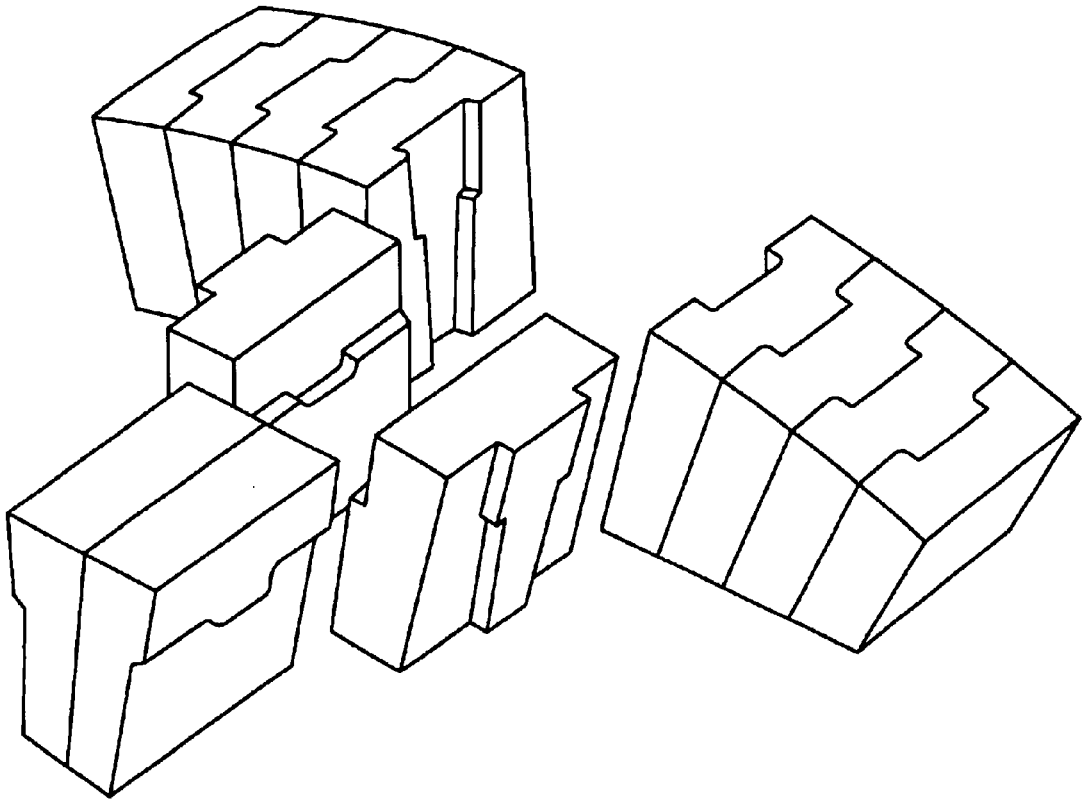
FIG. 14 shows a prior-art supporting-arch construction with the keystone and adapter stone separated.
Figure 15:
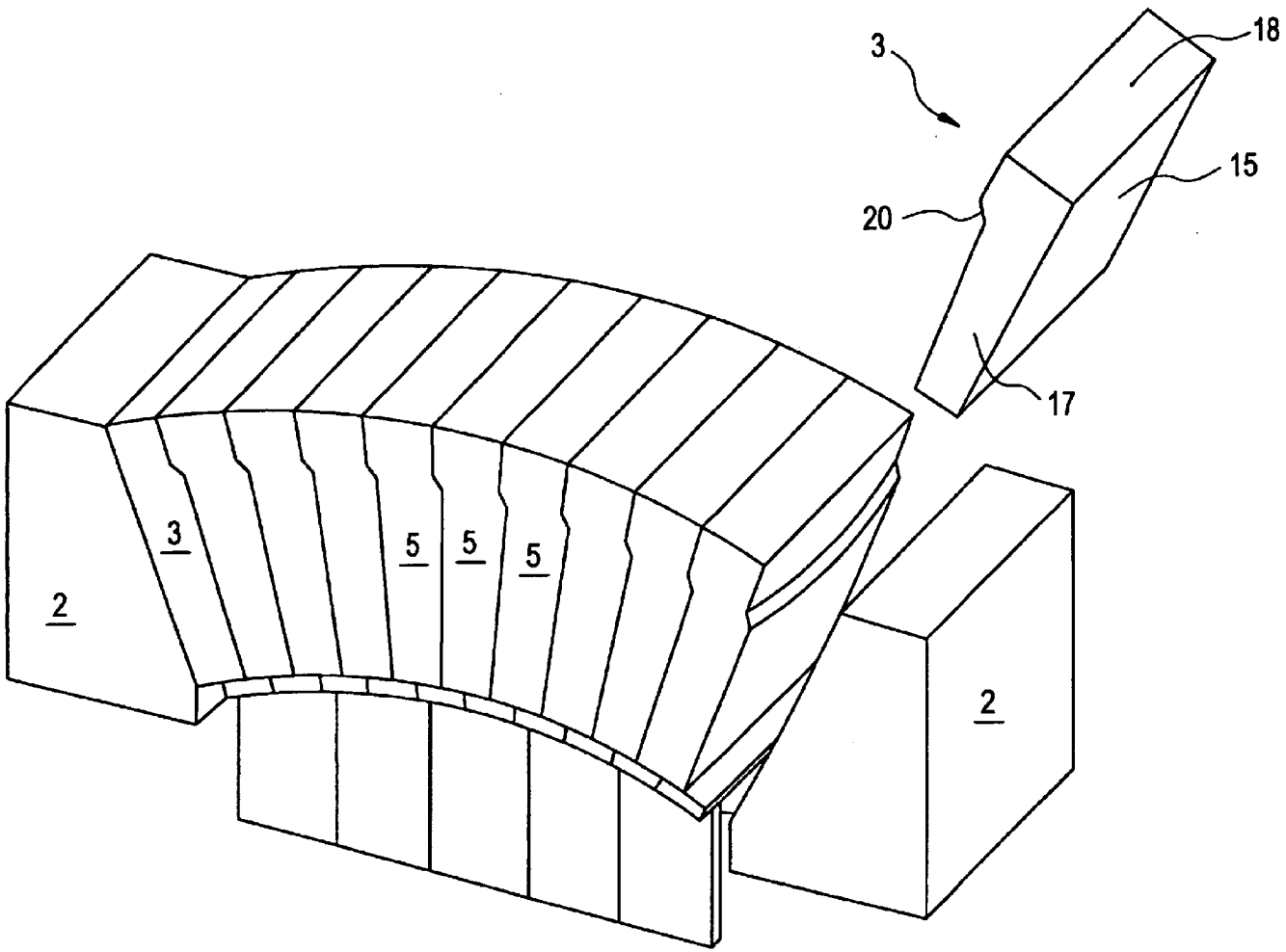
FIG. 15 shows a perspective view of a supporting-arch construction according to the invention from FIG. 1, showing supporting arch blocks with centers.
Figure 16:
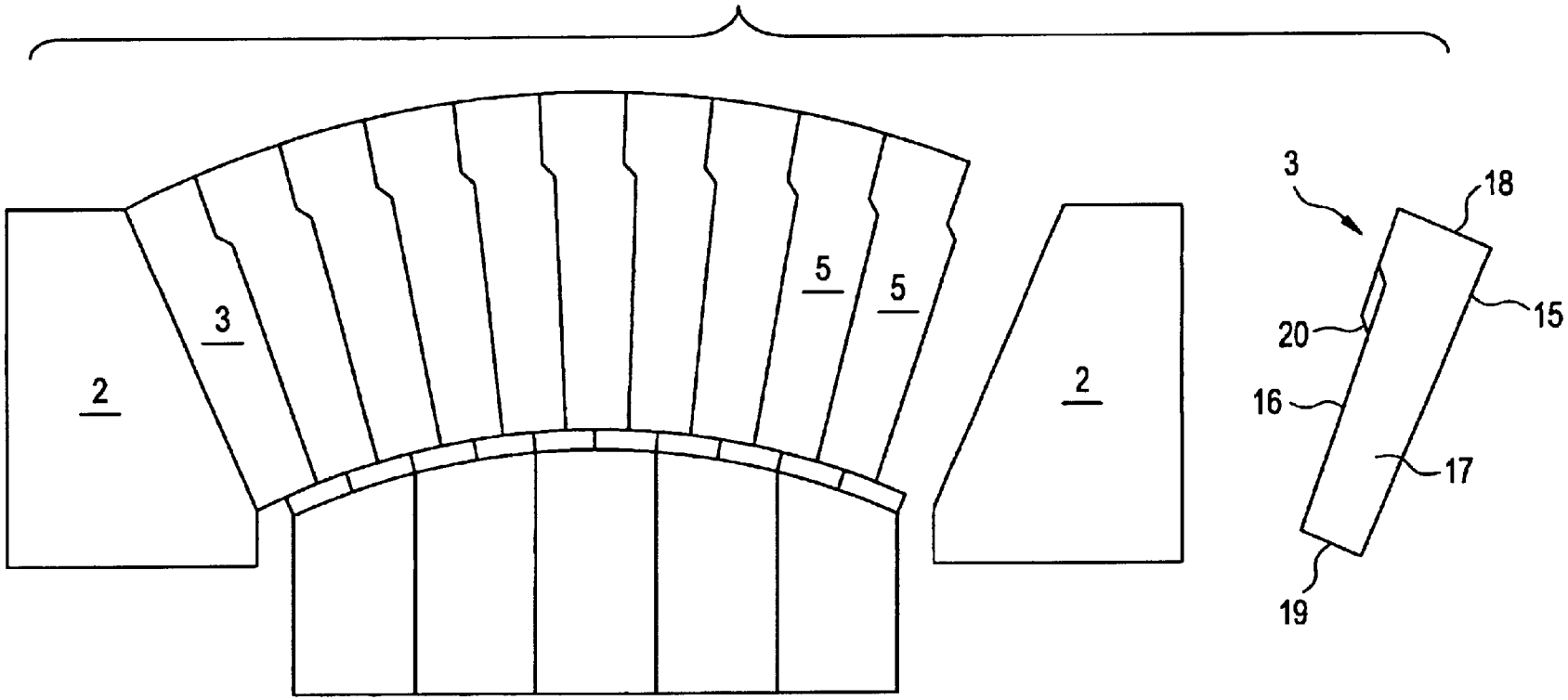
FIG. 16 shows a plan view of the construction according to the invention from FIG. 15.
Figure 17:
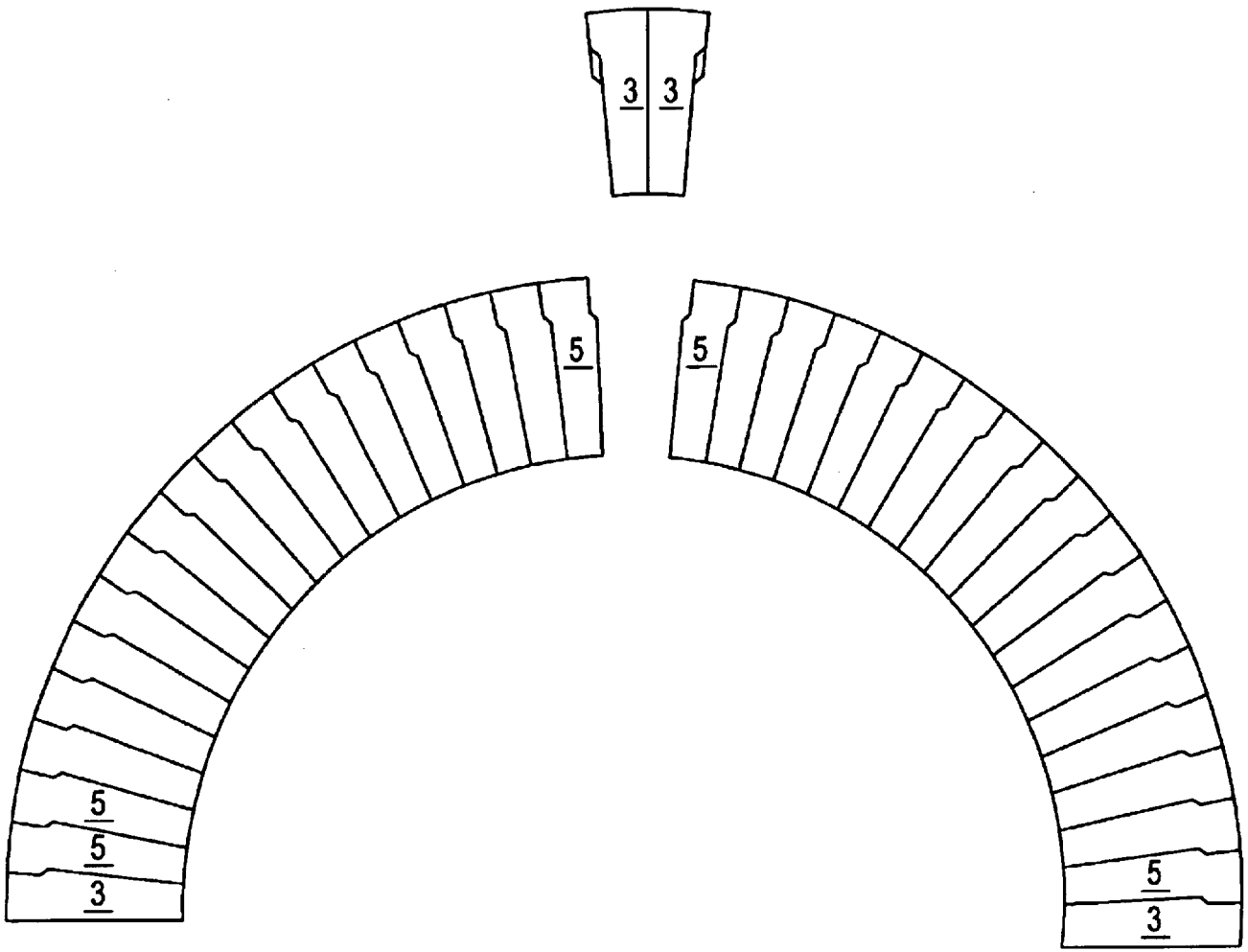
FIG. 17 shows a plan view of another embodiment, showing supporting arch blocks with barrel vaults.
Figure 18:
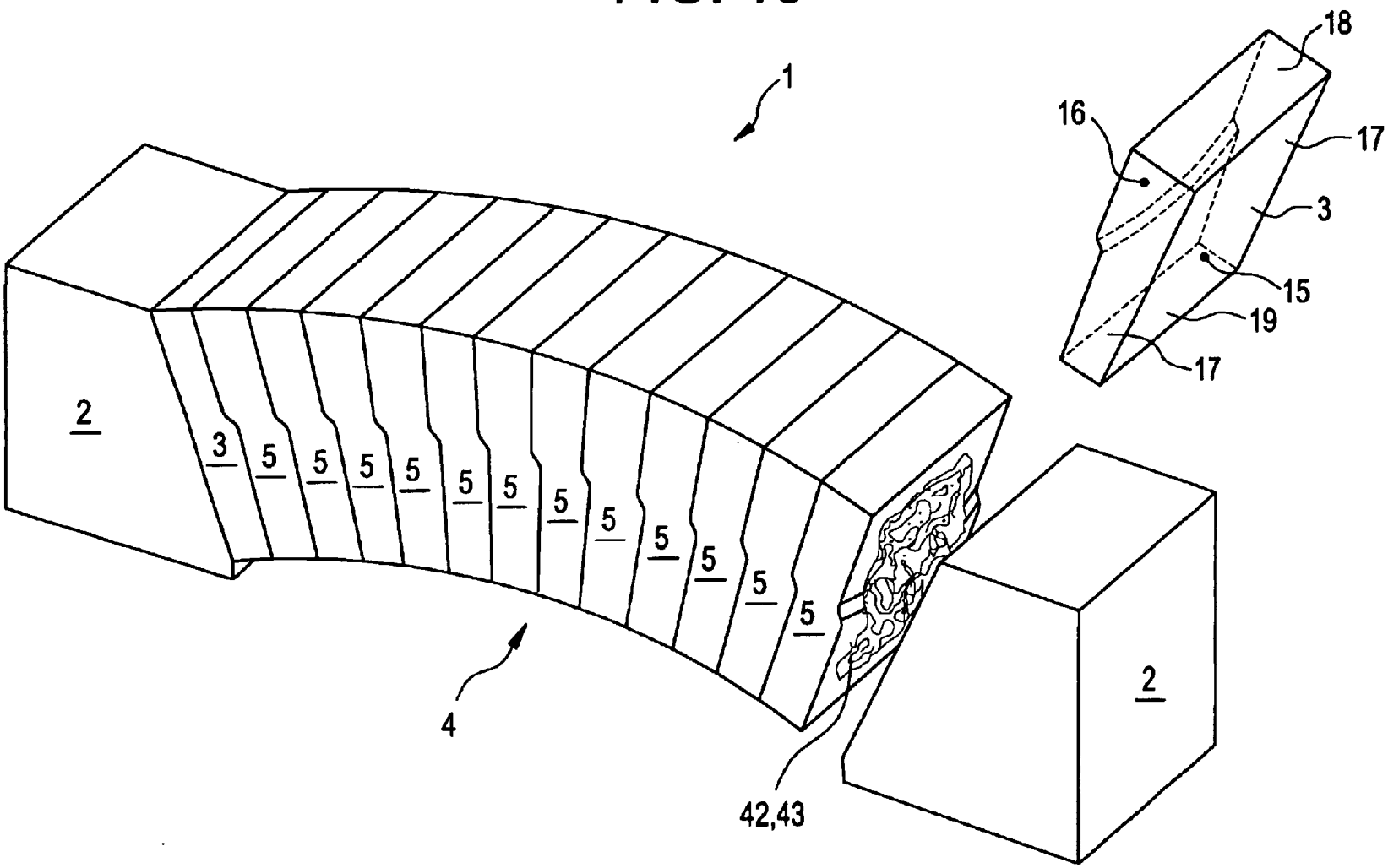
FIG. 18 shows a perspective view of a supporting-arch construction according to the invention from FIG. 1, showing supporting arch blocks with thin bed mortars or adhesives.

It is noted that FIG. 13 shows the supporting arch blocks and the first and second imposts fixedly positioned on one another. Moreover, FIG. 13 shows the situation of a supporting arch construction being installed in an existing masonry structure, such as the masonry structure of vertical lime kilns. Further, the drawings show supporting arch blocks with centers shown in FIGS. 15 and 16, thin bed mortars or adhesives 42, 43 shown in FIG. 18, and barrel vaults shown in FIG. 17.

In the case of the process according to the invention, it is advantageous that, in the case of repairs, the hitherto time-consuming and costly operation of removing the masonry structure located above the supporting arch may be dispensed with.

What is claimed is:

1. A process for producing a supporting arch with a supporting-arch construction, comprising:

laying a first impost (3) on a first abutment element (2) or a first abutment block (2), laying supporting-arch blocks (5) of an arcuately curved supporting arch (4) in a form-fitting manner between the first impost (3) and an opposite, second impost (3) which follows a last one of the supporting-arch blocks (5), positioning the secnod impost (3) with a form fit engagement between the last one of the supporting-arch blocks (5) and a second abutment element (2) or a second abutment block (2), and installing correspondingly oversized or undesized first and second imposts (3) in order to compensate for production tolerances or dimensional inaccuracies.

2. The process as claimed in claim 1, wherein, to provide for an easier installation and alignment, the supporting-arch blocks (5) and the first and second imposts (3) are fixedly positioned on one another.

3. The process as claimed in claim 2, wherein the supporting-arch blocks (5) and the first and second imposts (3) are fixedly positioned on one another by centers, thin-bed mortars or adhesives.

4. The process as claimed in claim 1, wherein the first and second imposts (3) and the supporting arch (4) are positioned on a center, the center being arranged between the first and second abutment blocks (2).

5. The process as claimed in claim 1, wherein the first and second imposts (3) and the supporting-arch blocks (5) are laid so that side walls (17, 29) thereof are aligned.

6. The process as claimed in claim 1, wherein, for adaptation of the second impost (3) to the supporting arch (4), a last impost (3) comprising three imposts, in each case undersized, of standard size and oversized in respect of a tapering thereof, is selected and installed.

7. The process as claimed in claim 1, wherein a supporting-arch construction is used for supporting arches in vertical lime kilns.

8. The process as claimed in claim 1, wherein a supporting construction is used for barrel vaults.

9. A supporting-arch construction for industrial furnances, comprising:

a supporting-arch construction having two abutment elements (2) or blocks (2), one abutment voussoir (3) or impost (3), in each case, engaging against a respective one of the abutment elements (2), a supporting arch (4) extending in an arcuate curve between the imposts (3), the supporting arch (4) including a plurality of supporting-arch blocks (5), each of the supporting-arch blocks (5) having the same construction, each of the supporting-arch blocks (5) including one wall (25) having a first contour thereon, and also including a corresponding second contour on an opposite wall (26) thereof, so that the first contour of one supporting-arch block (5) is engaged in a form-fitting engagement with the second contour of an adjacent supporting-arch block (5), one impost (3) having the first contour, and another impost (3) having the second contour, the first and second contours, in each case, including a step (20, 30, 31) provided on a respective wall (25, 26, 16), the step (20, 30, 31) being arranged so that the step (20, 30, 31) runs obliquely at an angle from a higher-level wall plane to a lower-level wall plane, with the step (20, 30, 31) running initially parallel to base walls (28, 19) from side walls (17, 29, and the step (20, 30, 31) being inflected in a center of the side wall (17, 29), coming from both sides, so that an upwardly or downwardly directed, essentially triangular, parallelogram-shaped, rectangular or square nose (37) or recess (38) is provided along a course of the step.

10. The construction as claimed in claim 9, wherein the imposts (3) and the supporting-arch blocks (5) are essentially wedge-shaped, tapering from a top side of the supporting arch (4) to an underside of the supporting arch (4).

11. The construction as claimed in claim 9, wherein the abutment elements (2) or blocks (2) are of essentially cuboidal construction and have a base wall (6), a rear wall (7), a top wall (8), two side walls (9) and a front or bearing wall (10), the front or bearing wall (10) having a narrow wall section (11) adjacent to the base wall (6) running parallel to the rear wall (7), and a bearing surface (12) is provided above the wall section (11) and extends obliquely, at a predetermined angle, in a direction of the rear wall (7) and terminates with the top wall (8).

12. The construction as claimed in claim 9, wherein the impost (3) has a bearing wall (15), a supporting wall (16) located opposite the bearing wall (15), two parallel side walls (17) connecting the bearing wall (15) to the supporting wall (16), a top wall (18), and a base wall (19) located opposite the top wall (18), the impost (3) tapering from the top wall (18) in a direction of the base wall (19).

13. The construction as claimed in claim 9, wherein the supporting-arch blocks (5) have a wedge-shaped construction including a front supporting wall (25) and a rear supporting wall (26) arranged so that the front and rear supporting walls (25, 26) run toward one another from a common top wall (27) to a common base wall (28), the front and rear supporting walls (25, 26) being connected by two planar side walls (29).

14. The construction as claimed in claim 9, wherein the step (20, 30, 31) runs obliquely at a ramp angle between 30° and 60°.

15. The construction as claimed in claim 9, wherein the step (20, 30, 31) runs concavely or convexly in an arcuate curve from one side wall (17, 29) to an opposite side wall (17, 29).

16. The construction as claimed in claim 9, wherein the step (20) runs in an arcuate curve as a segment of a circle.

17. The construction as claimed in claim 9, wherein the step (20) runs in an arcuate curve as an oval segment.

18. The construction as claimed in claim 9, wherein the step (20, 30, 31) runs in an undulating manner.

19. The construction as claimed in claim 9, wherein the step (20, 30, 31) runs in an arcuate curve from a top wall (18, 27) or base wall (19, 28), so that recesses (35) are provided in walls (16, 26) which open in a direction of the top wall (18, 27) or the base wall (19, 28) or noses or protuberances (36) which widen toward the respective top wall (18, 27).

20. In a supporting-arch construction for industrial furnances, including:

a supporting-arch construction having two abutment elements (2) or blocks (2), one abutment voussoir (3) or impost (3), in each case, engaging against a respective one of the abutment elements (2), a supporting arch (4) extending between the imposts (3), the supporting arch (4) including a plurality of supporting-arch blocks (5), each of the supporting-arch blocks (5) having the same construction, each of the supporting-arch blocks (5) including a front supporting wall (25), an opposite back supporting wall (26), a ceiling wall (27), a floor wall (28) and two side walls (29), the front supporting wall (25) of the supporting-arch blocks (5) having a protruding first contour thereon to provide a step (30), the opposite back supporting wall (26) of the supporting-arch blocks (5) having a corresponding recessing second contour therein to provide a step (31), so that the first contour of one supporting-arch block (5) is engaged in the second contour of an adjacent supporting-arch block (5), an improvement comprising:

(a) the supporting-arch blocks (5) being wedge-shaped so that the front supporting wall (25) and the back supporting wall (26) are tapered towards each other starting from the ceiling wall (27) to the floor wall (28), (b) each of the steps (30, 31) extending from one side wall (29) to the opposite other side wall (29), (c) the step (30) of the first contour extending downwardly to the floor wall (28) and having an arcuate concavely arched construction, and (d) the step (31) of the second contour also extending downwardly to the floor wall (28) and having a convexly arcuated construction.

21. In the construction as claimed in claim 20, wherein one impost (3) has a protruding first contour and the other impost (3) has a corresponding recessing second contour therein.

22. In the construction as claimed in claim 20, wherein the first and second contours in each case includes a step (20, 30, 31) provided on a respective wall (25, 26, 16), the step (20, 30, 31) being arranged so that the step (20, 30, 31) runs obliquely at an angle from a higher-level wall plane to a lower-level wall plane.

23. The construction as claimed in claim 22, wherein the step (20, 30, 31) runs obliquely at a ramp angle between 30° and 60°.

24. The construction as claimed in claim 22, wherein the step (20) runs in an arcuate curve as a segment of a circle.

25. The construction as claimed in claim 22, wherein the step (2) runs in an arcuate curve as an oval segment.

26. The construction as claimed in claim 22, wherein the step (20, 30, 31) runs in an undulating manner.

27. The construction as claimed in claim 22, wherein the step (20, 30, 31) runs initially parallel to base walls (28, 19) from side walls (17, 29), and is inflected in a center of the side wall (17, 29), coming from both sides, so that an upwardly or downwardly directed, essentially triangular, parallelogram-shaped, rectangular or square nose (37) or recess (38) is provided along a course of the step.

28. The construction as claimed in claim 22, wherein the step (20, 30, 31) runs in an arcuate curve from a top wall (18, 27) or base wall (19, 28), so that recesses (35) are provided in walls (16, 26) which open in a direction of the top wall (18, 27) or the base wall (19, 28) or noses or protuberances (36) which widen toward the respective top wall (18, 27).

29. The construction as claimed in claim 28, wherein the step (20, 30, 31) has an acutely oval, oval, circle-segment-like, serrated, or stepped contour.

30. The construction as claimed in claim 20, wherein the abutment elements (2) or blocks (2) are of essentially cuboidal construction and have a base wall (6), a rear wall (7), a top wall (8), two side walls (9) and a front or bearing wall (10), the front or bearing wall (10) having a narrow wall section (11) adjacent to the base wall (6) running parallel to the rear wall (7), and a bearing surface (12) is provided above the wall section (11) and extends obliquely, at a predetermined angle, in a direction of the rear wall (7) and terminates with the top wall (8).

31. The construction as claimed in claim 30, wherein the bearing surface (12) of the bearing wall (10) is of planar construction.

32. The construction as claimed in claim 30, wherein the bearing surface (12) of each bearing wall (10) bears on an adjacent one of the imposts (3).

33. The construction as claimed in claim 20, wherein the impost (3) has a bearing wall (15), a supporting wall (16) located opposite the bearing wall (15), two parallel side walls (17) connecting the bearing wall (15) to the supporting wall (16), a top wall (18), and a base wall (19) located opposite the top wall (18), the impost (3) tapering from the top wall (18) in a direction of the base wall (19).

34. The construction as claimed in claim 33, wherein the supporting wall (16) has a contour in order to achieve a form-fitting engagement with a following adjacent supporting-arch block (5).

* * * * *